United States Patent [19]

Harrop et al.

[11] Patent Number: 4,855,711

[45] Date of Patent: Aug. 8, 1989

[54] IMPACT DETECTION APPARATUS

[75] Inventors: David Harrop, Newark; Bradley A. Sharpe-Geisler; Valli R. Sharpe-Geisler, both of San Jose, all of Calif.

[73] Assignee: Sensor Science, Newark, Calif.

[21] Appl. No.: 68,192

[22] Filed: Jun. 29, 1987

[51] Int. Cl.[4] ..... G08B 23/00; A63C 19/06

[52] U.S. Cl. ..... 340/323 R; 340/590; 340/598; 340/665; 340/666; 273/29 R; 273/31; 200/86.5; 200/211; 200/268

[58] Field of Search ..... 340/323 R, 573, 550, 340/590, 598, 626, 665-667; 273/31, 61 R, 29 R, 50, 374; 434/339; 200/61.1, 61.11, 85 R, 85 A, 86.5, 211, 212, 267, 268, 269, DIG. 1, DIG. 35

[56] References Cited

U.S. PATENT DOCUMENTS 3,825,919 7/1974 Levin et al. ..... 340/550
3,982,759 9/1976 Grant ..... 340/323 R
4,062,008 12/1977 Carlsson et al. ..... 340/323 R
4,365,805 12/1982 Levine ..... 340/323 R

*Primary Examiner*—Donnie L. Crosland
*Attorney, Agent, or Firm*—Robert K. Stoddard

[57] ABSTRACT

An impact detection apparatus (10) includes a device that utilizes multiple sensor elements (11) to determine whether or not a ball lands in or out on a tennis court (12). The sensor positions (13–134) are adjacent to the various boundary lines of the tennis court (12). The sensor elements (11) are layered devices which, when compressed, generate an electrical impulse. The impulse is then analyzed through various signal processing means so that an impact caused a sensor (11) to be compressed may be characterized as being a ball, a footstep, or some other object. In this way, near-simultaneous impacts of a ball and a footstep can be distinguished. If the impact is characterized as a ball that has landed out, a control console (206) will give a visual and/or audible signal so that players, and officials if present, are informed that the ball was out.

19 Claims, 5 Drawing Sheets

IMPACT DETECTION APPARATUS

TECHNICAL FIELD

The present invention relates generally to monitoring devices and more specifically to an apparatus to determine whether a detected impact is on one side or the other of a given boundary, e.g. whether a ball is in or out on a tennis court.

BACKGROUND ART

The primary application of the present invention is envisioned to be in conjunction with the game of tennis. Tennis is a game in which the outcome of each point may be controlled by the determination of whether a ball lands within or on a given boundary, and is therefore "in", or whether the ball lands beyond the boundary, and is therefore "out". To the player of ordinary skill, this determination is generally within reasonable limits. The casual player's shots, and indeed the player himself, do not generally travel with great velocity. This ordinarily keeps the in/out determination within the bounds of human visual capabilities. Further, at the casual level, the in/out determination is usually not critical to matters other than personal pride. Generally, nothing more is at stake. However, as the skill level of the players rises, the situation becomes more complex.

Tennis officials have long recognized that at top levels, the speed at which the ball travels on shots, (in excess of 100 mph at times), combined with the fact that the player who would ordinarily be required to make the call will often also be moving at top speed and generally does not have the best visual perspective, frequently makes it impossible for the player to perceive accurately whether the ball was in or out. That the player does not have the best perspective of where a ball lands has been proven repeatedly. See, e.g., "In or Out", Robert H. Vincent, TENNIS, March, 1984, p.35; and "Vic Braden's Startling Revelations about Line Calls", Vic Braden, TENNIS, May, 1983, p. 37. Recognition of this fact has led to the use of linespeople at all major competitions. The linespeople are positioned so that they have a fixed parallel viewpoint of the boundary lines, which greatly reduces the number of erroneous calls. Unfortunately, the use of linespeople is prohibitively expensive for most play. Only those tournaments with large budgets can afford to use linespeople. Further, even with linespeople there is still the possibility of erroneous calls. Numerous studies, including those cited above, have consistently shown that the in/out determination is often quite simply beyond the bounds of human perception.

Improved accuracy in in/out determinations is desirable at all skill levels. However, at the top levels of competitive tennis, the skill and level of play differentials between the winner and loser of a given match can be very minute. One or two key points can determine the outcome. Considering that hundreds of thousands of dollars are at stake in the major professional tournaments, it is not difficult to understand the extreme desirability of eliminating human error in making line calls.

The prior art includes several examples of devices that have been built to provide a method of determining, on a tennis court, whether or not balls land in or out. The most common method involves a surface contact detection system in conjunction with a specially adapted tennis ball. See "Game Court Boundary Indicator System", Jokav and Grill. U.S. Pat. No. 3,774,194, issued Nov. 20, 1973; "Gaming face Contact Detecting Systems" Van Auken, U.S. Pat. No.4,1O9,9ll, issued Aug. 29 1978; and "Micro-Computer Network Systems for Making and Using Automatic Line-Call Decisions in Tennis", Supran, U.S. Pat. No. 4,432,058 issued Feb. 14, 1984.

The inherent disadvantage of these systems is of course that the tennis balls must be altered in one way or another. The Jokay device requires that three conductive winding be installed in the interior cavity of the tennis ball. The Van Auken system alters the exterior surface by requiring that at least one portion of the surface be electrically conductive. The Supran system also envisions the use of an electrically conductive ball. These conductive balls are likely to be prohibitively expensive. A further problem with altering the ball is that changing the ball may change the game. Thus a line calling system that requires modified balls could be expected to meet great resistance, as most players would be very hesitant to accept anything other than the standard tennis ball. Furthermore, the governing organizations and equipment manufacturers are highly resistant to change of this nature. The number of years it took for the optic yellow balls to be accepted is proof of the tendency.

A more useful sort of system is the "Tennis Court Line Monitoring Apparatus" of Grant, U.S. Pat. No. 3,982,759,issued Sept. 28, 1976. This system uses a series of small mechanical switches activated by the impact of the ball. This means the system will operate when a standard ball is used. However, since the switches are closed by physical contact, if a player is standing on the switched area, that senor cannot detect the impact of the ball. There is no way to detect the secondary impact. (Defining secondary impact as an impact on a switch that is already activated.)

In any system the detector area is broken into regions. In the switch type sensor, a region consists of multiple normally open switches all wired in parallel. With this arrangement any closed switch within a region closes the circuit for that region. Thus, if someone is standing in a region (activating it), the impact of a tennis ball anywhere within that region will have no effect (it will not be sensed). To minimize the risk of this occurring, a large number of smaller regions has to be used which requires a prohibitively large number of channels, A second disadvantage of the switch type senor is that the means of discrimination between a footstep and a ball impact is limited to measuring pulse width. (It is inherently a single threshold device, with the threshold set by the mechanical parameters of the switch.) It can thus be fooled by a tap dancer, and likewise a quick footed tennis player.

Another method in the prior art is the use of light beams. One such system, known as "Cyclops", has been used at many professional tournaments. To date, the system has been used only on the service lines, not all the boundaries. One of the problems with this type of system is that anything that breaks the beam triggers the device. There is no way to distinguish between, for instance, a player's foot and the ball.

All the devices in the prior art suffer from at least one of the above shortcomings. They either require the use of a modified ball, they have no means to detect a secondary impact, or they have no means to differentiate between contacts caused by various objects.

DISCLOSURE OF THE INVENTION

Accordingly, it is an object of the present invention to provide an automated method of determining whether an object strikes an area within a certain boundary, specifically, whether a ball lands "in" or "out" on a tennis court.

Another object of the present invention is to provide an apparatus that allows the use of standard tennis balls.

It is another object of the present invention to provide an apparatus that can effectively discriminate among various impact events.

Yet another object of the present invention is to provide an apparatus that can be effectively used with only a single official, or by the players themselves.

A further object of the present invention is to provide an apparatus that can detect a secondary impact.

Briefly, a preferred embodiment of the present invention is an impact detection apparatus. The apparatus achieves a method of automated determination of whether or not a ball lands in or out on a tennis court. The apparatus includes a plurality of large surface area charge pump transducers, strategically placed in the critical areas of the court. Any impact upon the transducers generates an electrical impulse, which can then be processed. Signal processing provides the means to determine whether the impact was that of a tennis ball or a footstep. The apparatus also includes monitoring means. The monitoring means provides a visual and/or audible signal when a ball has landed out. It is envisioned that the system will generally be used with a non-participant controlling its operation. However, the system can be used in the absence of an operating official.

An advantage of the present invention is that it allows for infinitely variable levels of detection, thus making it possible to differentiate the impact of a tennis ball from that of a footstep.

Another advantage of the present invention is that it makes use of a standard tennis ball.

Yet another advantage of the present invention is that it helps eliminate human error from the determination of whether a ball has landed in or out.

Still another advantage of the present invention is that it can detect a secondary impact.

These and other objects and advantages will become clear to those skilled in the art in view of the description of the best presently known mode of carrying out the invention and the industrial applicability of the preferred embodiment as described herein and as illustrated in the several figures of the drawing.

BRIEF DESCRIPTION OF THE DRAWINGS

FIG. 4 is an example of waveforms produced by the bounce of a tennis,

FIG. 5 is an alternate example of waveforms produced by the bounce of a tennis ball;

BEST MODE OF CARRYING OUT THE INVENTION

Figure 1:
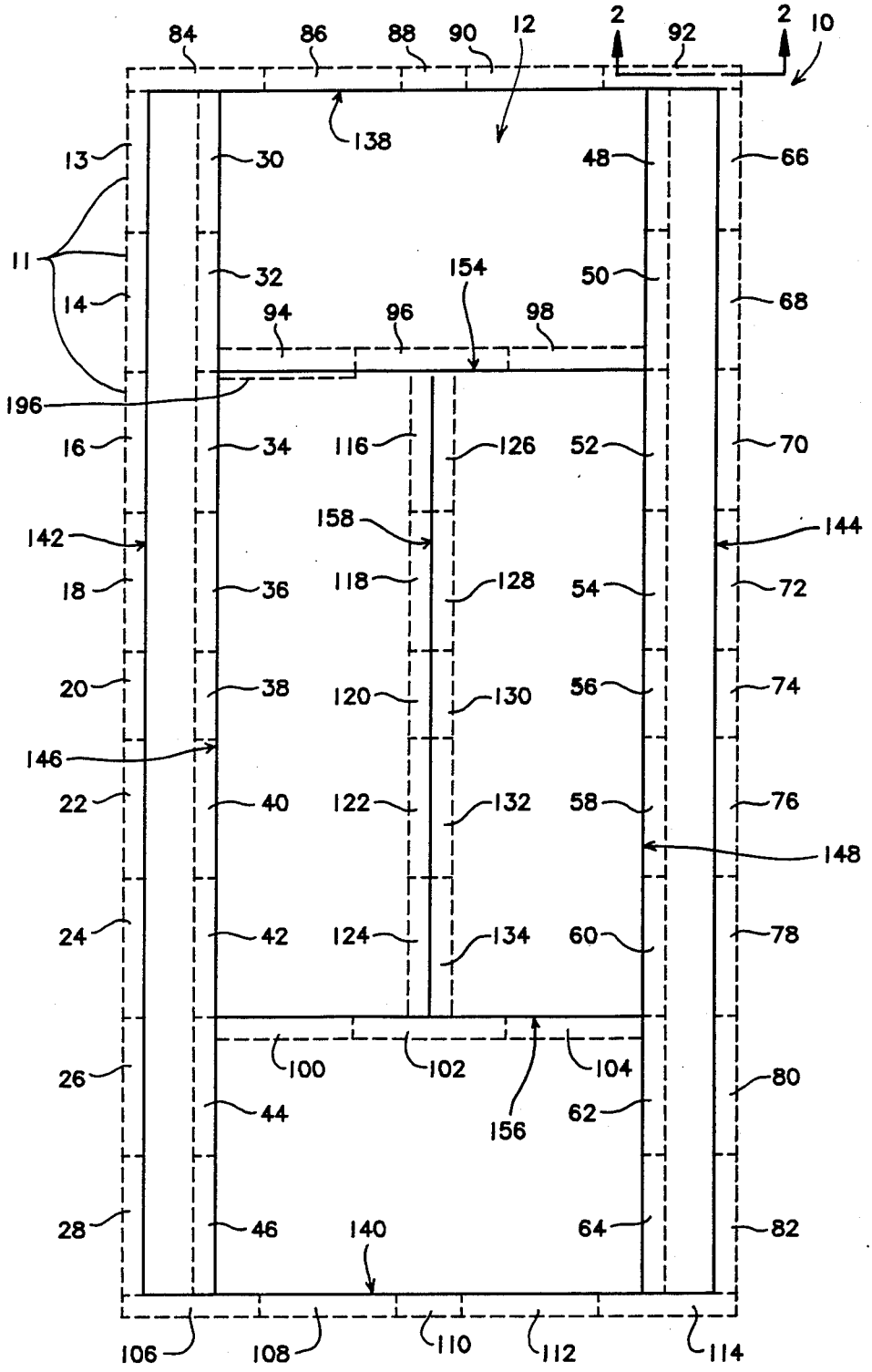
FIG. 1 is a schematic view of a preferred embodiment the inventive apparatus installed on a tennis court, the solid lines indicating the boundaries of the court, and the broken lines indicating the placement of the charge pump transducers.

The present invention is an impact detection apparatus that can be utilized to detect localized impact events. The presently preferred embodiment is specifically adapted to monitor the boundaries of a tennis court. The preferred embodiment of the apparatus is shown in the drawing as a system combining several individual components and is collectively referred to by the general reference character 10 The sensing components of the apparatus are a plurality of large area charge pump transducers, termed sensors, which are differentiated by their positioning. For clarity of description, each sensor 11 is identified, according to its specific position on a conventional tennis court 12, by the reference characters 13 through 134. The sensors 11 are situated outside the boundaries of the component areas of the tennis court 12, in the arrangement depicted in FIG. 1. The sensors 11 are mounted underneath and/or made part of the playing surface.

The sensors 11 are situated so as to abut the exterior edge of each the boundaries of the tennis court 12. The outermost boundaries of the court 12 are a first end line 138, a second end line 140, a first doubles side line 142, and a second doubles side line 144. If the court 12 is being used for singles, the lateral boundaries are a first singles side line 146 and a second singles side line 148. The interior of the court 136 is further defined by a first service line 154, a second service line 156, and a center line 158.

Each sensor 11 is in the form of an elongated rectangle having one long edge linearly adjacent to the exterior edge of one of boundary lines. For example, the sensor 98 is contiguous with the rear edge of the first service line 154 and will be utilized to determine whether a serve has landed out. The width of the sensors 11 is chosen bearing in mind that a ball landing more than a given distance away from a boundary line will be readily discernible to the unaided human eye. In one embodiment, the sensors 11 are 48.3 cm (19.0 in) wide, that is, they extend 48.3 cm (19.0 in) beyond the outer edge of the boundary lines. The length is chosen only as a matter of convenience, but is about 2.74 m (9.0 ft.) in the preferred embodiment.

Figure 2:
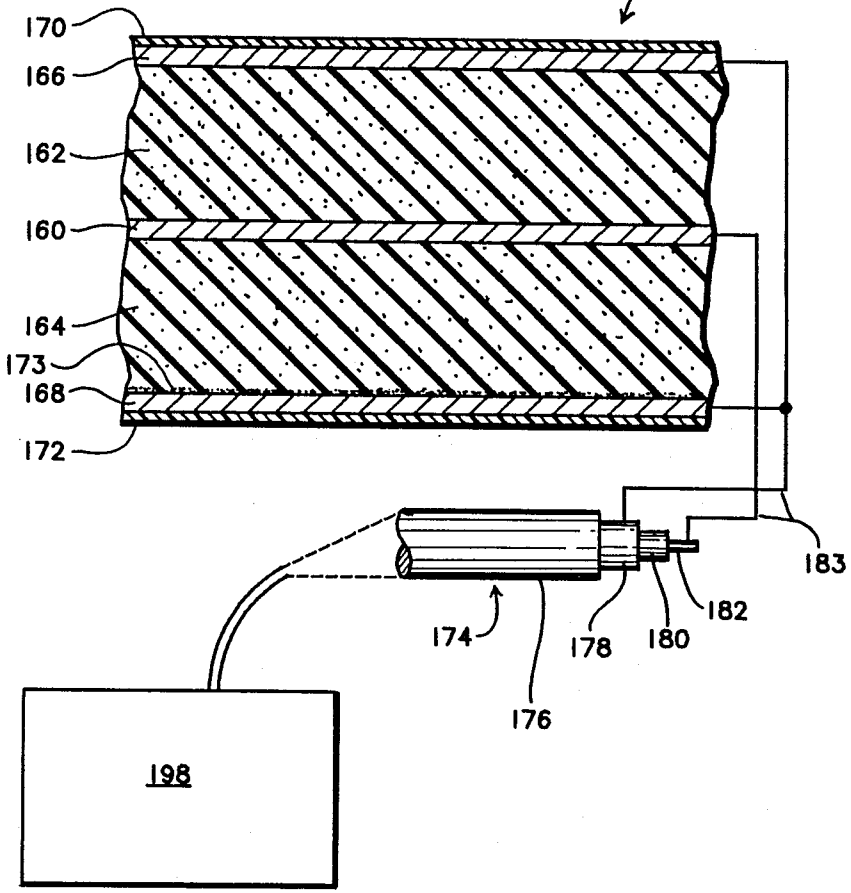
FIG. 2 is a broken cross-sectional view of a sensor with no pressure applied taken along line 2—2 of FIG. 1.
Figure 2:
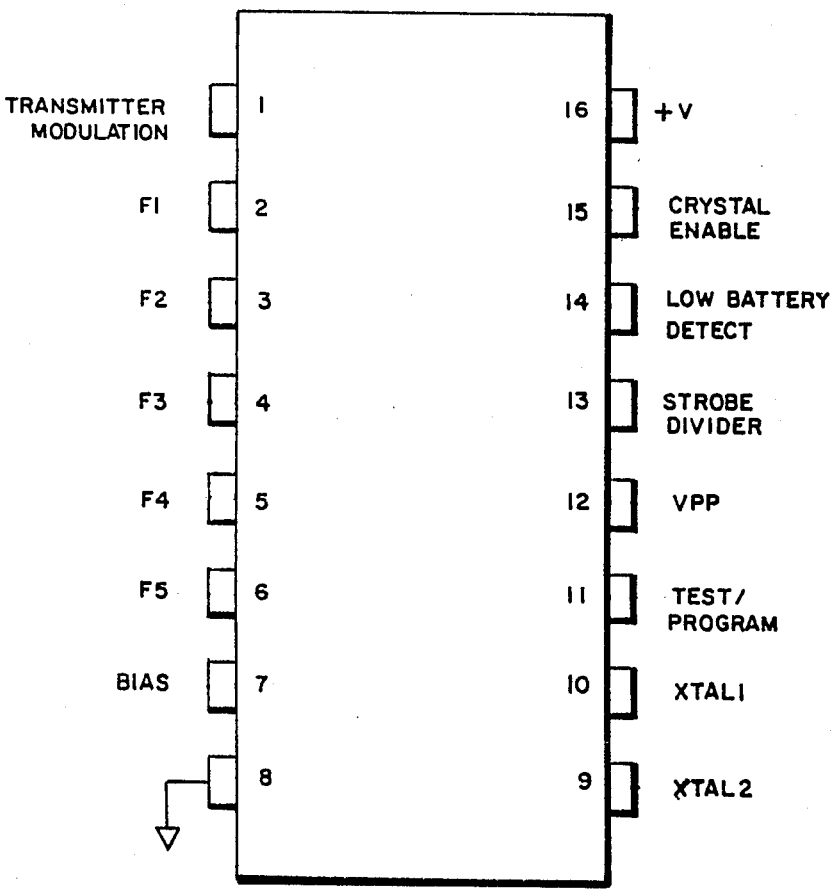

Each sensor 11 is a multilayered device, with the various layers serving varying functions. The sensors 11 are laterally consistent such that a cross section along any vertical plane will yield an identical pattern of layers. As shown in FIG. 2, each sensor 11 includes an inner conductive layer 160 situated between a first insulating layer 162 and a second insulating layer 164. Above the first insulating layer 162 is a first outer conductive layer 166, and beneath the second insulating layer 164 is a second outer conductive layer 168. These layers are enclosed by an upper coating 170 and a lower coating 172. The various layers 160, 162, 164, 166, and 168 are bound together by adhesive 173 (shown only with respect to the boundary between layers 164 and 168 but understood as being present at each boundary). It is envisioned that the conductive layers 160, 166, and 168 will be aluminum metal foil, although any resilient conductive material will suffice. The insulating layers 162 and 164 may be any compressible, non-conductive material. The preferred embodiment utilizes closed cell elastomer foam in layers 162 and 164. The coating layers 170 and 172 are simply durable plastic to protect the other layers.

The sensors 11 operate as transducers, known as "charge pump" transducers in the preferred embodiment. In this application, a total displaced charge ("Q") is the integral of "i(dt)" over a given time interval with "i" representing electrical current and "t" representing time. The symbol "i" represents the displacement current that is generated during compression, and is defined by V(dc/dt), where "V" is the fixed voltage maintained between the inner conductive layer 160 and the outer conductive layers 166 and 168, and "dc/dt" is the time rate of change in capacitance due to compression. Note that the displacement current i is independent of the size of the sensor, but depends only on the voltage maintained and the rate of change of compression (reflected as a rate of change in the distance between conductive layers). Current is carried to and from the sensors 11 by means of a standard coaxial cable 174. The coaxial cable 174 is shown in FIG. 2 with its component parts; an outer cover 176, a shield wire 178, an insulation layer 180, and an interior wire 182. The outer conductive layers 166 and 168 are in electrical contact via connecting wiring 183 with the shield wire 178. The inner conductive layer 160 is in electrical contact via connecting wiring 183 with the interior wire 182.

Figure 3:
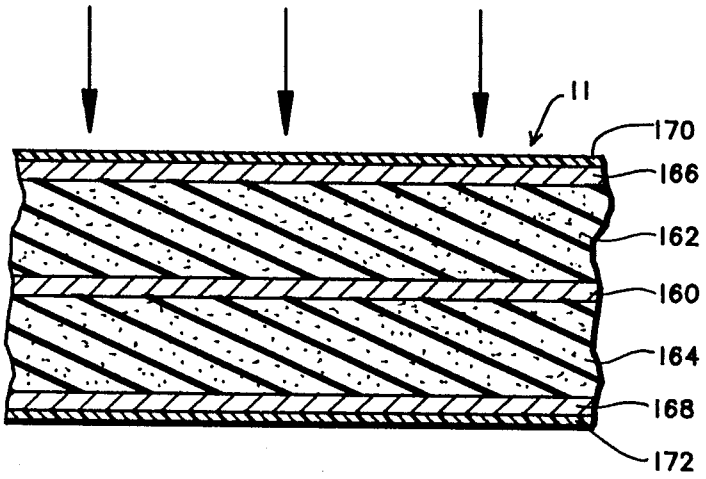
FIG. 3 is a broken cross-sectional view of the same sensor as FIG. 2, shown with pressure applied.

When pressure is applied to the sensor 11, i.e. when there is an impact, the foam layers 162 and 164 are compressed. (See FIG. 3.) Therefore in the impact area, the distance between the inner conductive layer 160 and outer conductive layers 166 and 168 is reduced. This compression, through the relationship defined above, yields a displacement current which is analyzed to determine what caused the impact.

In an alternate embodiment, the second insulating layer 164 is not compressible. Therefore, when an impact occurs, only the first insulating layer 162 is compressed. This reduces the distance between the first outer conductive layer 166 and the inner conductive layer 160, Which also yields a displacement current which can be analyzed, through signal processing, to determine what caused the impact. The processing of this signal is equivalent to the processing of the signal output by the preferred embodiment.

Figure 6:
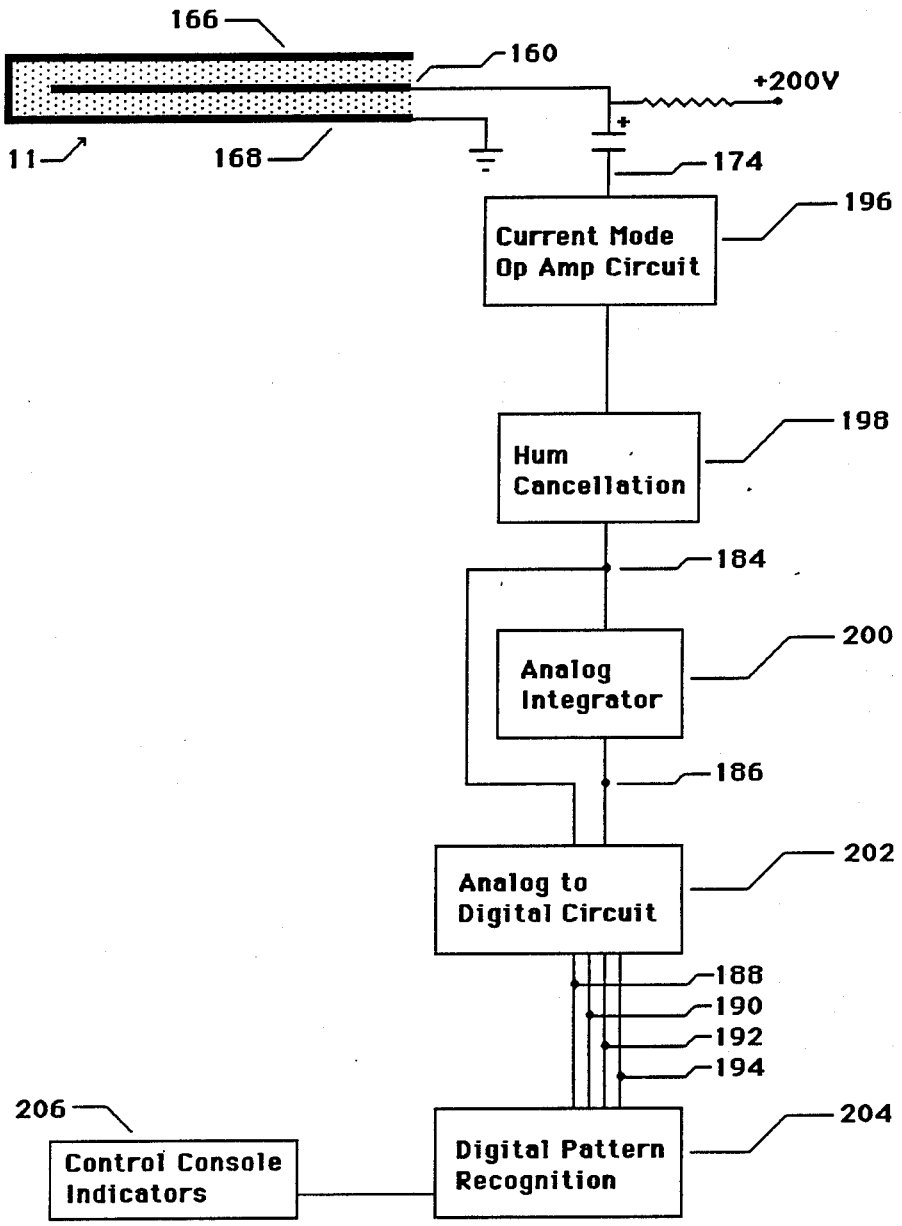
FIG. 6 a flow chart type of block diagram illustrating the sensor and associated signal processing elements.

Once a raw signal has been generated in the sensor 11 by an impact of any kind upon the upper coating layer 170 it is necessary to analyze the signal to determine whether it is a relevant triggering impact (i.e. a ball) or a spurious impact (i.e. a foot or a racket). Many available methods of signal analysis may be utilized to make this determination but one preferred method is illustrated in FIGS. 4, 5 and 6 of the drawing. These figures are considered together in the following discussion. FIGS. 4 and 5 illustrate typical waveforms, both analog and digital, generated by a tennis ball impact, while FIG. 6 is a flow chart block diagram illustrating the method of analysis.

FIG. 4 illustrates a first analog waveform 184 corresponding to the current generated Within the sensor 11 corresponding to a ball impact. The shape of the waveform 184 is generally sinusoidal since the current generated within a given sensor 11 is dependent upon the rate of change of separation between the outer conductive layers 166 and 168 and the inner conductive layer 160. The waveform 184 illustrated in FIG. 4 is inverted from the actual signal generated since, by the time the current signal is observed in the analysis apparatus of the preferred embodiment 10, it has passed through an inverter element.

FIG. 5 illustrates a charge displacement analog waveform 186 which will be generated as a result of the same impact generating the current analog waveform 184 of FIG. 4. The charge displacement analog waveform 186 represents the net charge displaced in the charge pump transducer of the sensor 11 upon an impact. Charge displacement is directly dependent upon the separation between the conductive layers 160, 166 and 168 and is the integral of the current. Thus, the charge displacement waveform 186 is obtained by integrating the current waveform 184 (inverted). It is noted that with an alternate detection apparatus it might be possible to directly measure charge displacement and then take the derivative over time to obtain the current waveform. However, since it is easier to measure the current, the order of generation illustrated in FIGS. 4 and 5 is the more practical approach.

Since charge displacement directly (inversely) corresponds to the separation distance between the conductive layers, with charge displacement increasing as separation decreases, the charge displacement waveform 186 directly mirrors the vertical motion of the surface impact point on the sensor 11 over the time interval of the impact event.

The generation of the current and charge displacement waveforms 184 and 186 upon an impact event is as follows. Initially, the system is static and separation is constant. This is represented by point A in FIGS. 4 and 5. The rate of change of separation is zero and the charge displacement is constant so both waveforms 184 and 186 are represented as corresponding to baselines. As the tennis ball impacts the upper coating layer 170 of the sensor 11 (Point B) the separation distance begins rapidly decreasing. Thus the charge displacement increases and the current increases in a derivative fashion. At a point shortly after impact (Point C) the rate of depression of the impact point reaches a maximum. After Point C, the ball continues to depress the sensor 11 further but its rate is slowed by the compression resistance of the insulating layers 162 and 164 and that of the ball itself. This results in the current waveform 184 returning toward the baseline (zero). At maximum compression (Point D) the impact force and resilient forces are balanced and the ball is actually instantaneously stationary. The rate of separation change (current) is zero and the separation distance is minimized (charge displacement maximized). From Point D forward the resilience (bounce) of the ball and the conductive layers 166 and 168 take over and the sensor 11 begins to return to normal shape. At some point within this resilient interval (Point E), the rate of expansion reaches its maximum and the current minimizes, although a significant degree of compression still exists. When the ball leaves the upper coating surface 170 (Point F) the sensor returns (assuming no relevant oscillation) to the static condition (Point G) which corresponds to the initial static condition (Point A). The impact event is then completed.

In order to most effectively analyze the analog waveforms 184 and 186 the preferred analysis circuitry utilizes various signal magnitude detectors to generate step functions (digital signals) corresponding to aspects of the waveform. As seen in FIG. 4 the preferred circuitry generates a first digital current signal 188 based upon a first current threshold 189. The first digital current signal 188 is switched from a low mode to a high mode when the first analog current signal 184 has a negative magnitude exceeding the selected first current threshold 189. Similarly the circuitry generates a high mode in a second digital current signal 190 when the first analog waveform 184 has a positive magnitude exceeding that of a second current threshold 191. The digital current signals 188 and 190 are more easily recognized by subsequent analysis circuitry than the raw waveform 184 and also permit more detailed determinations.

In a similar manner, FIG. 5 illustrates how a first digital charge displacement signal 192 is generated when the charge displacement analog signal 186 has a magnitude exceeding a first charge displacement threshold 193 while a second digital charge displacement signal 194 is generated when a second charge displacement threshold 195 is exceeded. It is noted that while the first and second digital current signals 188 and 190 are mutually exclusive, the first and second digital charge displacement signals 192 and 194 are both in the high mode at the same time with the second charge signal 194 having a longer duration than the first charge signal 192.

The analysis circuitry utilized in the preferred embodiment of the present invention is illustrated in a flow chart style of block diagram in FIG. 6. In this illustration it may be seen that the sensor 11 generates current signals carried by the coaxial cable 174 to the analysis elements. The inner conductive layer 160 is provided with a +200 volt potential while the first and second outer conductive layers 166 and 168 are grounded. The compression of the sensor 11 causes a current to flow in the coaxial cable 174. This current is first delivered to a current mode op amp (operational amplifier) 196. This element amplifies and inverts the signal and passes it to a hum cancellation subcircuit 198. The hum cancellation subcircuit 198 acts to filter out system hum generated in the AC power line so that the desired signals are more easily recognized.

The output of the hum Cancellation subcircuit 198 is in the form of the first analog current waveform 184. It is then split with one branch being delivered to an analog integrator 200 while the other branch is delivered directly to an analog to digital converter circuit 202. The branch delivered to the analog integrator is integrated therein to generate the charge displacement analog waveform 186.

The analog to digital converter circuit 202 receives the analog waveforms 184 and 186 and outputs the digital signals 188, 190, 192 and 194. These digital signals are then delivered to a digital pattern recognition module 204. The digital pattern recognition module 204 electronically sorts the digital signals and, upon proper matches for a ball impact, sends an activation signal to a control console 206. Depending on the nature of control console 206 selected an indicator of some type (horn, bell, light, etc.) will be triggered to alert the players and/or officials to the fact that the ball has hit outside the boundary.

Figure 7:
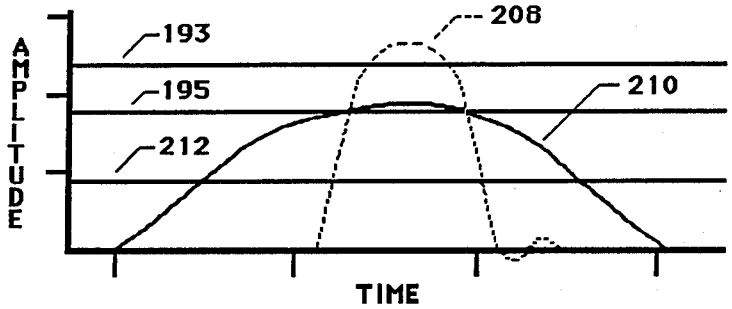
FIG. 7 is a waveform diagram showing signals generated by a ball impact and a light foot-tap analyzed with respect to three thresholds.

The necessity of being able to provide multiple detection thresholds can be shown by reference to FIGS. 7–10. Each of these figures represents a plot of selected signal amplitude versus elapsed time. FIG. 7 depicts a first analog signal (ball analog signal) 208 of the same type as the charge density analog signal 186 from a ball impact (shown as a dotted line) and a second analog signal (toe tap analog signal) 210 of the same nature generated by a light toe tap impact, such as when a player slightly steps over the boundary (shown as a solid line). The horizontal lines above the baseline represent the first charge displacement threshold 193, the second threshold 195, and a third charge displacement threshold 212. It may be seen that the ball analog signal 208 crosses all three thresholds 212, 195 and 193 while the toe tap analog signal 210 only exceeds the second and third thresholds 195 and 212. It is also noted that the duration of the toe tap signal 2lD is longer than that of the bouncing ball signal 208.

Figure 8:
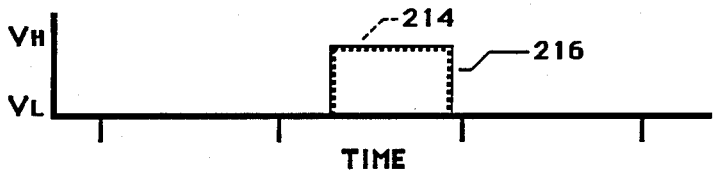
FIG. 8 is a waveform diagram showing the digital equivalents of the waveforms of FIG. 7 analyzed with respect to a single selected detection threshold.

FIG. 8 depicts what could happen if a detection system utilized only a single threshold, such as an on-off switching mechanism of the nature of some prior art devices. For example, if only the second charge displacement threshold 195 were utilized, the signals illustrated in FIG. 8 would be generated. In this instance a single ball impact digital signal 214 (dotted) is generated resulting from the ball analog signal 208 exceeding the second threshold 195. This ball digital signal 214 is of the same nature as the second charge displacement digital signal 194 of FIG. 5. A similar type of signal is generated as a toe tap digital signal 216 (solid line). As may be seen in FIG. 8, the two digital signals 214 and 216 are congruent, having (by definition) the same magnitude and also the same duration in this case. Thus for a ball impact and toe tap impact occurring anywhere on the sensor (about nine feet in length in the preferred embodiment) the signal threshold analysis mechanism would be unable to distinguish the two impact events. False indications could therefore result in an appreciable percentage of instances as the digital pattern recognition subsystem 204 would be incapable of recognizing the toe tap as an extraneous event. This is an undesirable result.

Figure 9:
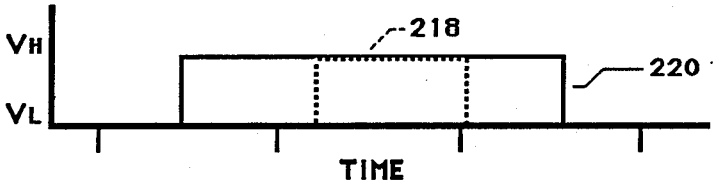
FIG. 9 is a waveform diagram showing the digital equivalents of the waveforms of FIG. 7 analyzed with respect to a single selected detection threshold, the selected threshold being lower than that selected in FIG. 8.

FIG. 9 illustrates the result of similar processing utilizing the third charge displacement threshold 212 as the triggering magnitude. In this case the ball impact digital signal 218 and the toe tap digital signal 220 again (by definition) have the same magnitude but have different durations. In this case the pattern recognition subsystem 204 would be able to distinguish the impacts by a duration comparison.

Figure 10:
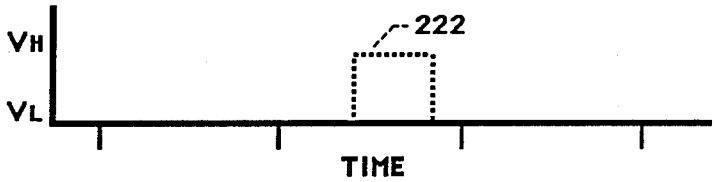
FIG. 10 is a waveform diagram showing the digital equivalents of the waveforms of FIG. 7 analyzed with respect to a single selected detection threshold, the selected threshold being higher than that selected in FIG. 8.

FIG. 10 illustrates the results based upon the first charge displacement threshold 193. In this instance Only a ball impact digital signal 222 is generated since the toe tap analog signal 210 never achieves the magnitude of the first threshold 193. In this system only the ball impact would be detected by the pattern recognition subsystem 204. However, a heavy foot impact, rather than the light impact illustrated in FIG. 7, could result in a spurious match.

As seen in FIGS. 7–10 it is possible to distinguish between ball impacts and other types of impacts on the sensor 11 by the use of multiple threshold analysis. It has been established that a ball bounce will generate analog signals having patterns within a specified range of parameters. Other types of impacts generate signals having different ranges. By empirically determining the thresholds and durations corresponding to ball impacts and excluding other impacts it is possible to program the pattern recognition subsystem to be nearly foolproof in its recognition of actual ball impacts. In this manner the accuracy of in versus out determinations may be drastically improved over previously utilized methods and the degree of certainty of line judgments may be maximized.

Note also that the apparatus 10 of the present invention is not disabled by two near-simultaneous impacts. Some of the prior art devices operate on an on/off basis. That is, a signal is generated when a switch is physically closed by an impact. Therefore, in the prior art systems, if a player steps (or is standing) on the subject area and a ball then lands there, the system would have no means to detect the impact of the ball. Since there is no on/off aspect to the present invention, a sensor 11 is not disabled after a primary impact. Additional compression from a ball impact will simply result in another measurable signal being created. It is therefore able to transmit a signal based on a secondary impact, a characteristic which sets it apart from the prior art.

Another problem that can arise in detecting the impact of a tennis ball is that, due to the tennis ball's compressibility, the impact point is not discrete. At high speeds (the ball's velocity often exceeds 100 mph) the ball skids, maintaining contact with the playing surface for a distance of up to 15 cm (6 in.). The problem becomes that a ball that begins its skid in bounds can be detected as out before the end of the skid. To avoid this, a secondary sensor 224 can be installed in conjunction with each of the primary sensors 13 through 134, as shown in FIG. 1 in association with sensor 94. The secondary sensor 224 operates in exactly the same manner as the primary sensors 11. The secondary sensor 224 is simply a narrower sensor that is installed abutting the primary sensors 13 through 134, but inside the boundaries of the tennis court 12. The function of the secondary sensor 196 is to detect the impact of a ball that is in, and override the detection circuitry associated with the corresponding primary sensor, so that when the end of the skid is detected, no out signal is given.

For example, FIG. 1 shows the secondary sensor 224 corresponding to sensor 94. When sensor 94 is enabled the secondary sensor 224 is also enabled. When secondary sensor 224 detects the impact of a ball, it overrides the output from sensor 94 so that the ball is not signaled as out, even if it skids into out territory. It is envisioned that these primary/secondary sensor couplings will be necessary only where high velocity impacts would be common, e.g. the service lines 154 and 156.

It is envisioned that the sensors' operation Will be controlled by a control console 206 (see FIG. 6) that will be operated by the presiding official. When the apparatus 10 is set for singles play, signals from sensors 13–28 and 66–82 will be ignored by the circuitry, since the doubles side lines 142 and 144 are not relevant boundaries. Conversely, when the apparatus 10 is set for doubles play, sensors 30, 46, 48, and 64 will be deactivated, as they relate solely to the singles boundaries.

The presiding official controls the sensors necessary to call the serve. Once the ball is put in play, certain of the sensors required for the service will be in the playing area and must be deactivated. For example, consider a serve to the service area defined by the first singles side line 146, the first service line 154, and the center line 158. Sensors 32, 34, 36, 38, 94, 96, 116, 118, and 120 would be activated. During singles play, sensors 94, 96, 116, 118, and 120 would have to be deactivated immediately after the serve. During doubles play, sensors 32, 34, 36 and 38 would also have to be deactivated, so that the lateral boundary will be the doubles side line 142.

The control console 206 will also include visual and/or audible signaling means which will be triggered when one of the sensors 13 through 134 detects a ball as out. That is, a light will flash and/or a beeper will sound so that the players and official(s) are aware that a ball has landed out. If desired, the control console 206 can include different signals for the various lines. For example, separate lights could correspond to the service lines 154 and 156, side lines 146 and 148 or 142 and 144, and end lines 138 and 140 respectively. Further, differing audio signals could also be utilized so that players would know specifically which boundary has been exceeded.

Those skilled in the art will readily observe that numerous modifications and alterations of the device may be made while retaining the teachings of the invention. Accordingly, the above disclosure is not intended as limiting. The appended claims are therefore to be interpreted as encompassing the entire spirit and scope of the invention.

INDUSTRIAL APPLICABILITY

The impact detection apparatus of the present invention is specifically adapted for use on a tennis court. As discussed previously, the determination of whether a ball is in or out is absolutely essential in the game of tennis. The present invention allows the possibility of human error to be removed from the determination. Given the incredible amounts of money involved in modern tennis, this is a very desirable result. Therefore tournament organizers will be quite amenable to the purchase of a device that will accomplish the result. The present invention would fill that need.

Further the present invention could also be used in other applications. Court games, such as racquetball, handball, and squash, are the most obvious extensions. But the present invention would also have utility in other games where boundaries are important, such as basketball or football. Indeed, the present invention is useful in any situation where an impact must be detected, particularly if there are varying degrees of impact that must be differentiated.

For the reasons stated above, it is expected that the impact detection apparatus of the present invention will enjoy widespread commercial utility and industrial applicability.

IMPACT DETECTION APPARATUS CORRESPONDENCE CHART

10 — Impact Detection Apparatus
11 — Sensor Element
12 — Tennis Court
13–34 — Sensor Positions
138 — First End Line
140 — Second End Line
142 — First Doubles Side Line
144 — Second Doubles Side Line
146 — First Singles Side Line
148 — Second Singles Side Line
154 — First Service Line 156 — Second Service Line
158 — Center Line
160 — Inner Conductive Layer
162 — First Insulating Layer
164 — Second Insulating Layer
166 — First Outer Conductive Layer
168 — Second Outer Conductive Layer
170 — Upper Coating
172 — Lower Coating
173 — Adhesive
174 — Coaxial Cable
176 — Outer Cover
178 — Shield Wire
180 — Insulation Layer
182 — Interior Wire
183 — Connective Wiring
184 — Current Analog Waveform
186 — Charge Displacement Analong Waveform
188 — First Digital Current Signal
189 — First Current Threshold
190 — Second Digital Current Signal
191 — Second Current Threshold
192 — First Digital Charge Displacement Signal
193 — First Charge Displacement Threshold
194 — Second Digital Charge Displacement Signal
195 — Second Charge Displacement Threshold
196 — Current Mode Op Amp
198 — Hum Cancellation subcircuit
200 — Analog Integrator
202 — Analog to Digital Conversion Circuit
204 — Digital Pattern Recognition Subsystem
206 — Control Console
208 — Ball Analog Signal
210 — Toe Tap Analog Signal
212 — Third Charge Displacement Threshold
214 — Ball Digital Signal Based on Second Threshold
216 — Toe Tap Digital Signal Based on Second Threshold
218 — Ball Impact Digital Signal Based on Third Threshold
220 — Toe Tap Digital Signal Based on Third Threshold
222 — Ball Impact Digital Sign on First Threshold
Secondary Sensor

I claim:

1. An impact detection apparatus comprising:

a first primary multilayered sensor in the nature of a variable magnitude signal generating device situated so as to abut an area enclosed by a boundary of interest;

signal processing means having an input coupled to said multilayered sensor, said signal processing means being responsive to a variable magnitude input signal from said sensor and producing in response thereto an output signal indicative of whether an impact of a given object of interest has occurred to said sensor;

indicator means coupled to said signal processing means output signal for producing in response thereto a sensible signal indicative of impact of said given object of interest;

said multilayered sensor comprising a sandwiched multilayer device including in respective order:

a first outer conductive layer;

a first insulative layer;

an inner conductive layer;

a second insulative layer;

a second outer conductive layer;

said outer conductive layers being electrically interconnected to form an electrically shielded region therebetween within which said insulative layers and said inner conductive layer are disposed; and, at least one of said insulative layers is formed of a compressible insulative medium.

2. The apparatus of claim 1 further comprising:

a secondary sensor located within the boundary of interest and abutting the primary sensor, said secondary sensor being coupled to said signal processing means to supply thereto a secondary input signal indicative of impact on said secondary sensor to thereby detect the instance of the object of interest landing within the boundary and then sliding across the boundary where its impact will be detected by the primary sensor, said signal processing means being adapted to cancel a signal from the primary sensor upon receiving a signal from said secondary sensor.

3. The apparatus of claim 1 wherein said signal processing means comprises:

an analog-to-digital converter having an input coupled to said multilayered sensor, having a plurality of input-threshold levels, and producing a digital output signal representative of said input; and digital pattern recognition means coupled to said analog-to-digital converter output for comparison of said digital output signal to known characteristics of a corresponding digital signal produced by impact of said given object of interest, and producing in response to said comparison an output signal indicative of whether said digital output signal matches said corresponding digital signal, whereby said output signal is indicative of impact of said given object.

4. The apparatus of claim 1 wherein:

said first insulating layer is compressible to permit varying separation between said first outer conductive layer and said inner conductive layer, and the second insulating layer may be either rigid, semi-rigid, or compressible.

5. The apparatus of claim 1 wherein:

a fixed voltage is maintained between said inner conductive layer and each of said outer conductive layers; and a displacement current is generated when the distance between the inner conductive layer and the outer conductive layers is changed due to an impact.

6. The apparatus of claim 5 wherein:

the displacement current is converted to a digital pattern by signal processing means.

7. The apparatus of claim 1 wherein said signal processing means comprises:

first signal-magnitude detecting means responsive to said input signal and producing in response thereto a first step-function digital signal having a time duration substantially identical to the time during which said input signal exceeds a first threshold;

second signal-magnitude detecting means responsive to said input signal and producing in response thereto a second step-function digital signal having a time duration substantially identical to the time during which said input signal exceeds a second threshold higher than said first threshold; and digital pattern recognition means, responsive to said first and second step-function digital signals, for comparison of the characteristics of said digital signals to known characteristics of corresponding digital signals produced by impact of said given object of interest, and for producing in response to said comparison an output signal indicative of whether said first and second digital signals match said corresponding digital signals, whereby said output signal is indicative of impact of said given object.

8. The apparatus according to claim 7 further including:

hum cancellation means coupled to receive said input signal and to subtract therefrom a hum signal, said hum cancellation means being coupled to each of said signal magnitude detecting means to supply a substantially hum-free input signal thereto.

9. The apparatus of claim 7 wherein said signal processing means further comprises:

voltage source means coupled to said sensor for producing a constant voltage difference between said inner conductive layer and said outer conductive layers, whereby said input signal is a displacement-current analog of the derivative of impact deflection of said sensor;

analog integrator means responsive to said input signal for producing in response thereto an integrated output signal, whereby said integrated output signal is an analog of impact deflection of said sensor;

third signal-magnitude detecting means responsive to said integrated output signal and producing in response thereto a third step-function digital signal having a time duration identical to the time during which said integrated output signal exceeds a third threshold;

fourth signal-magnitude detecting means responsive to said integrated output signal and producing in response thereto a fourth step-function digital signal having a time duration identical to the time during which said integrated output signal exceeds a fourth threshold higher than said third threshold; and said digital pattern recognition means effects comparison of the characteristics of said first, second, third and fourth digital signals to known characteristics of corresponding digital signals produced by impact of said given object of interest, and produces in response to said comparison an output signal indicative of whether said digital signals match said corresponding digital signals, whereby said output signal is indicative of impact of said given object.

10. The apparatus according to claim 1 further comprising:

a second primary multilayered sensor in the nature of a variable magnitude signal generating device situated so as to abut an area enclosed by a boundary of interest;

said signal processing means input being coupled to each of said first and second multilayered sensors; and said signal processing means also determines which of said sensors to activate and which to deactivate, the determination being operator selectable and dependent upon which boundary of an area with plural boundaries is of interest at a given time.

11. An impact detection apparatus specifically adapted to determine whether or not a ball lands in or out on a tennis court, comprising:

a plurality of primary multilayered sensors located on said tennis court in a sensor array with each sensor being situated adjacent to the lines defining the boundaries of the court;

each of said plurality of multilayered sensors comprising a sandwiched multilayer device including in respective order;

a first outer conductive layer;

a first insulative layer;

an inner conductive layer;

a second insulative layer;

a second outer conductive layer;

in each of said devices, the outer conductive layers being electrically interconnected to form an electrically shielded region there between within which said insulative layers and said inner conductive layer are disposed;

in each of said devices, at least one of said insulative layers is formed of a compressible insulative medium;

signal processing means having an input coupled to each of said multilayered sensors, said signal processing means being responsive to variable magnitude input signals from said sensors and producing in response thereto output signals indicative of whether an impact of a tennis ball has occurred on said sensor array;

indicator means coupled to said signal processing means output signals for producing in response thereto a sensible signal indicative of impact of said tennis ball on said sensor array.

12. The apparatus of claim 11 wherein said signal processing means comprises:

first signal-magnitude detecting means responsive to one of said input signal and producing in response thereto a first step-function digital signal having a time duration identical to the time during which said input signal exceeds a first threshold;

second signal-magnitude detecting means responsive to said input signal and producing in response thereto a second step-function digital signal having a time duration identical to the time during which said one input signal exceeds a second threshold; and digital pattern recognition means responsive to said first and second step-function digital signals for comparison of said digital signals to corresponding digital signals characteristic of impact of said given object of interest and producing in response to said comparison an output signal indicative of whether said first and second digital signals match said corresponding digital signals, whereby said output signal is indicative of impact of said given object.

13. The apparatus according to claim 11 wherein:

said sensible signal is an audible and/or visual signal emitted when it is determined that a ball landed out; and said signal processing means also determined which of said sensors to activate and which to deactivate, the determination being operator selectable and dependent upon which boundaries of said tennis court are of interest at a given time.

14. The apparatus of claim 11 wherein said senor array includes, at each point along said boundary lines:

a primary sensor situated abutting the exterior edge of said line so as to detect the impact of a ball landing in the out area; and a secondary sensor situated abutting the interior edge of said line so as to detect the impact of a ball in the in area, the secondary sensor then providing a signal to override the corresponding primary sensor so that a ball skidding into the out area will not be indicated as having landed upon the primary sensor.

15. The apparatus of claim 11 wherein:

a fixed voltage is maintained between said inner conductive layer and said outer conductive layer; and a displacement current is generated by an impact of an object compressing one or both of the insulating layers, thereby reducing the distance between the inner conductive layer and one or both of the outer conductive layers.

16. The apparatus of claim 11 wherein:

the outermost of said conductive layers are provided with a protective coating layer to minimize deterioration, damage and interference with said conductive layers.

17. An impact detection apparatus, comprising:

a source of constant electric potential;

an impact sensor means coupled to said source of electric potential, said sensor means responding to impact thereon by producing an electrical current signal having a magnitude dependent on the rate of change of compression force;

said impact sensor means comprising a sandwiched multilayer device including in respective order:

a first outer conductive layer;

a first insulative layer;

an inner conductive layer;

a second insulative layer;

a second outer conductive layer;

said outer conductive layers being electrically interconnected to form an electrically shielded region therebetween within which said insulative layers and said inner conductive layer are disposed; and, at least one of said insulative layers if formed of a closed-cell elastomer form.

18. The apparatus of claim 17 wherein said outer conductive layers are electrically interconnected by being physically joined along at least one common edge thereof.

19. The apparatus of claim 17 wherein said source of potential is connected to said sensor means by a coaxial cable having an inner conductor, and an outer conductor surrounding said inner conductor, said inner conductor being connected to said inner conductive layer and said outer conductor being connected to said outer conductive layers.

* * * * *